US005996373A

United States Patent [19]

Greter et al.

[11] Patent Number: 5,996,373

[45] Date of Patent: Dec. 7, 1999

[54] CRYOGENIC AIR SEPARATION PROCESS AND APPARATUS

[75] Inventors: Lucien Greter, Le Plessis Trevise; François Venet, Paris, both of France

[73] Assignee: L'Air Liquide, Societe Ananyme Pour l'Etude et l'Exploitation des Procedes Georges Claude, Paris, France

[21] Appl. No.: 09/018,464

[22] Filed: Feb. 4, 1998

[51] Int. Cl.[6] ..... F25J 3/04

[52] U.S. Cl. ..... 62/656; 62/640

[58] Field of Search ..... 62/656, 657, 640, 62/641

[56] References Cited

U.S. PATENT DOCUMENTS

| | | | |
|---|---|---|---|
| 4,617,040 | 10/1986 | Yoshino | 62/656 |
| 4,698,079 | 10/1987 | Yoshino | 62/656 |
| 4,732,595 | 3/1988 | Yoshino | 62/656 |
| 4,853,015 | 8/1989 | Yoshino | 62/656 |
| 5,437,160 | 8/1995 | Darredeau et al. | 62/656 |

*Primary Examiner*—William Doerrler
*Attorney, Agent, or Firm*—Young & Thompson

[57] ABSTRACT

A cryogenic air separation process and apparatus in a distillation column having a top condenser. Air is compressed, purified and cooled to a temperature suitable for distillation. The air is separated in a distillation column so that an oxygen-enriched liquid and a nitrogen-enriched gas are produced within the column. A stream of cryogenic liquid is sent to the column and an oxygen-enriched liquid is sent from the column to the condenser. The flow rate of cryogenic liquid is regulated as a function of the level of oxygen-enriched liquid at the bottom of the column, and a product stream is withdrawn from the column.

4 Claims, 1 Drawing Sheet

CRYOGENIC AIR SEPARATION PROCESS AND APPARATUS

BACKGROUND OF THE INVENTION

The present invention relates to a process and apparatus for cryogenically separating air, and in particular to such a process and apparatus for the production of nitrogen.

It is well known to supply part of the refrigeration requirements of an air separation process by liquid assist. This involves the injection of a cryogenic liquid into the distillation column or a condenser of the column at a point where the liquid in the column has a similar composition to that of the liquid used for the liquid assist.

Examples of liquid assist processes are to be found in U.S. Pat. No. 2,908,144 and U.S. Pat. No. 3,620,032 and in <<Recent Developments in Industrial Oxygen Production >> by M. P. Dubs, Trans. Instr. Chem. Engs. Vol. 36, 1958.

The standard technique used to regulate the amount of liquid assist sent to a single column is to vary the amount of liquid injected into the column in dependence on the level of liquid in the top condenser of the column (see for example EP-A-0 144 430, EP-A-191 862, J53-14351, J61-24968, U.S. Pat. No. 2,685,181). The same regulation technique is disclosed in a general context in FR 2 076 020.

It is an object of the present invention to provide an air separation process which can be more accurately controlled.

According to the invention, there is provided a cryogenic air separation process in a distillation column having a top condenser, comprising compressing and purifying the air; cooling the air after compression and purification thereof to a temperature suitable for distillation;

separating the air in a distillation column so that an oxygen enriched liquid and a nitrogen enriched gas are produced within the column; sending a stream of cryogenic liquid to the column;

sending oxygen-enriched liquid from the column to the condenser;

regulating a flow rate of the cryogenic liquid in dependence on the level of oxygen enriched liquid at the bottom of the column; and withdrawing a product stream from the column.

Preferably the column is single column nitrogen generator with a top condenser.

There is further provided according to the invention a cryogenic air separation apparatus comprising a distillation column having a top condenser, means for providing cooled compressed air to the distillation column, means for removing nitrogen enriched fluid from the column, means for sensing a liquid level at the bottom of the column, means for sending oxygen-enriched liquid from the bottom of the column to the condenser, means for sending a cryogen liquid to the column, means for controlling the flow rate of the cryogenic liquid sent to the column in dependence on said liquid level.

The column may contain trays or packings of this structured or random type. As the column is generally of smaller diameter than the condenser, a requirement for increased refrigeration will be reflected by a drop in liquid level of greater magnitude that the drop in liquid level in the condenser. This enables the refrigeration requirement to met with greater accuracy.

BRIEF DESCRIPTION OH THE DRAWINGS

The single FIGURE is a schematic representation of the present invention.

DETAILED DESCRIPTION OF THE INVENTION

Figure 1:
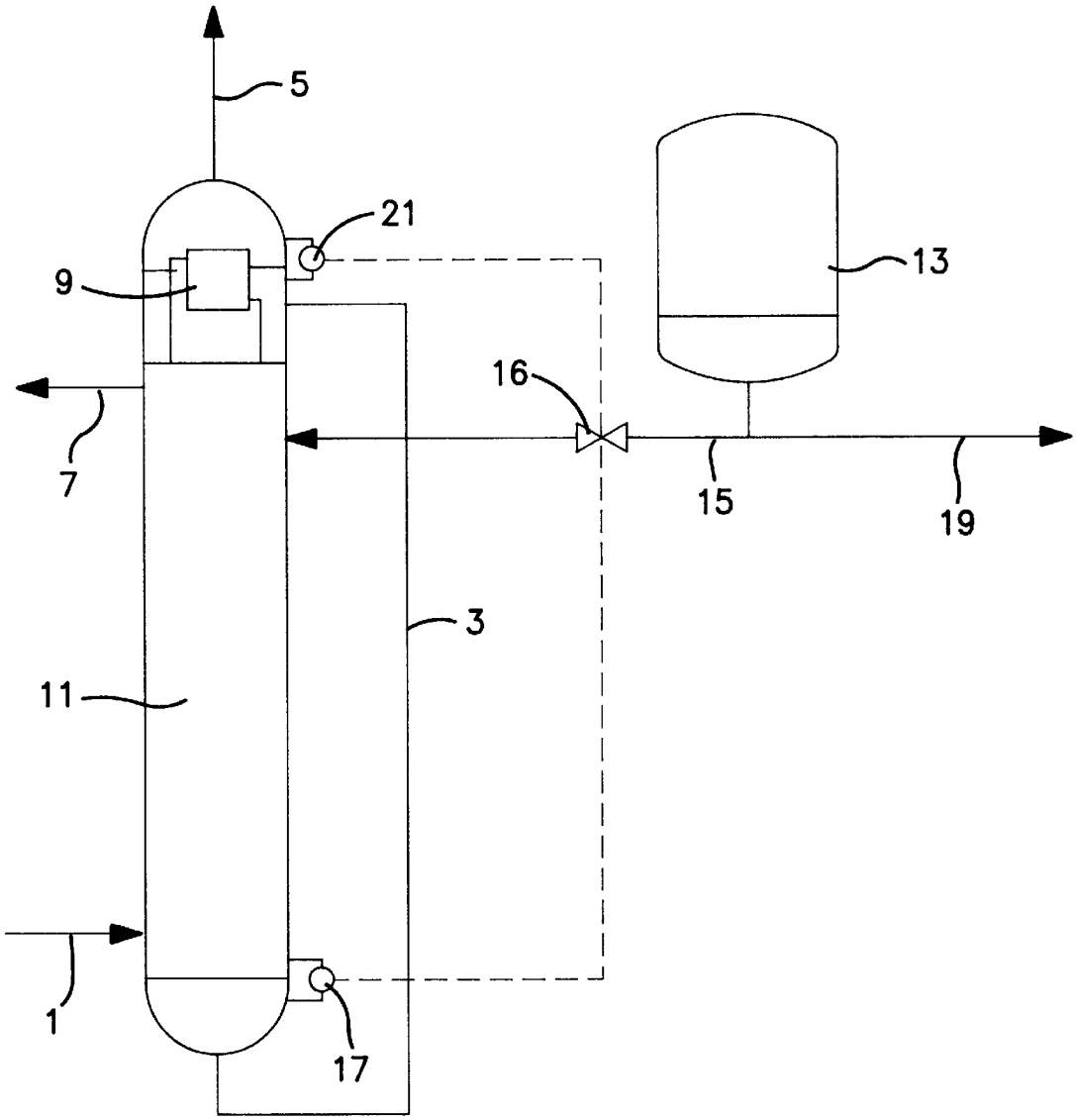

An air stream 1 is sent to the bottom portion of a single column nitrogen generator 11. Crude liquid oxygen 3 from the bottom of the column is sent to top condenser 9 which serves to condense the nitrogen formed at the top of the column. This condensation may be total or partial.

Product nitrogen gas or liquid 7 is removed from the top of the column and evaporated crude liquid oxygen 5 is removed from above the condenser.

Some or all of the refrigeration for the process is supplied by injecting liquid nitrogen from storage tank 13 into the top of the column via conduit 15 and valve 16. The opening of valve 16 is controlled in dependence on the liquid level at the bottom of the column 11 detected by LIC sensor 17.

Part of the refrigeration may optionally be provided by expansion of feed air or evaporated crude liquid oxygen.

As the liquid level rises, valve 16 reduces the amount of liquid nitrogen sent via conduit 15 and as the liquid level falls, valve 16 increases the amount of liquid nitrogen sent via conduit 15.

Optionally the flow of liquid nitrogen in conduit 15 may also be varied in dependence on the liquid level detected by sensor 21. Thus two liquid levels at different positions are used to control the cryogenic liquid injection.

What is claimed is:

1. A cryogenic air separation process in a single distillation column having a top condenser comprising:

compressing and purifying air;

cooling the air after compression and purification thereof to a temperature suitable for distillation;

separating the air in the distillation column so that an oxygen-enriched liquid and a nitrogen-enriched gas are produced within the column;

sending a stream of cryogenic liquid from an external source to a point of the column below the condenser;

sending oxygen-enriched liquid to the top condenser;

regulating a flow rate of the cryogenic liquid in dependence on the level of oxygen-enriched liquid at the bottom of the column; and withdrawing a product stream from the column.

2. A process according to claim 1, further comprising additionally regulating the flow rate of cryogenic liquid in dependence on the level of liquid in the top condenser.

3. A cryogenic air separation apparatus comprising:

a single distillation column having a top condenser;

means for providing cooled compressed air to the distillation column;

means for removing a nitrogen-enriched product from the column;

means for sensing a liquid level at the bottom of the column;

means for sending a cryogenic liquid from an external source to a point of the column below the condenser;

means for sending oxygen-enriched liquid from the bottom of the column to the condenser; and means for controlling the flow rate of the cryogenic liquid sent to the column in dependence on said liquid level.

4. The apparatus according to claim 3, further comprising means for sensing a further liquid level in the condenser, and controlling said flow rate in dependence on said further liquid level.

* * * * *